United States Patent [19]

Kohus et al.

[11] Patent Number: 4,798,412

[45] Date of Patent: Jan. 17, 1989

[54] TWO PIECE BOOSTER SEAT WITH MULTIPLE SEAT HEIGHTS

[75] Inventors: Louis M. Kohus; John V. Mariol, both of Cincinnati, Ohio

[73] Assignee: KohusMariol, Inc., Cincinnati, Ohio

[21] Appl. No.: 136,136

[22] Filed: Dec. 21, 1987

[51] Int. Cl.[4] ..... A47D 1/10

[52] U.S. Cl. ..... 297/250; 297/338

[58] Field of Search ..... 297/338, 250, 253, 345, 297/346; 248/423

[56] References Cited

U.S. PATENT DOCUMENTS

| | | | |
|---|---|---|---|
| D. 230,784 | 3/1974 | Turco | D6/3 |
| 257,065 | 4/1882 | Pursell | 297/338 X |
| 1,336,641 | 4/1920 | Linke | 297/338 |
| 2,538,231 | 1/1951 | Booth | 128/58 |
| 2,550,811 | 5/1951 | Herbert | 297/338 X |
| 3,575,465 | 4/1971 | Dolby | 297/118 |
| 3,724,895 | 4/1973 | Brand | 297/338 |
| 4,109,961 | 8/1978 | Opsvik | 297/338 |
| 4,266,306 | 5/1981 | Lee | 297/338 |
| 4,586,747 | 5/1986 | Taylor | 297/250 |
| 4,603,903 | 8/1986 | Moscovitch | 297/250 |

OTHER PUBLICATIONS

Juvenile Merchandising, Feb. 1987, Cover page and p. 4.

*Primary Examiner*—Francis K. Zugel

*Attorney, Agent, or Firm*—Charles R. Wilson

[57] ABSTRACT

A booster seat has provisions for accomodating a child in a number of different height positions. The booster seat comprises an open-sided base and a seat piece. The open-sided base has a forward channel and a back channel in each of two side supports. A seat of vertically spaced substantially level ledges are found in the channels, vertically offset from one another. The seat piece has a forward protrusion and a back protrusion on each side edge. The protrusions are vertically offset a distance substantially equal to the offset distances between the ledges so that when the protrusions engage the ledges in the base, the seat piece is substantially horizontal and secured in the open-sided base.

15 Claims, 4 Drawing Sheets

TWO PIECE BOOSTER SEAT WITH MULTIPLE SEAT HEIGHTS

This invention relates to a booster seat for use by children. More particularly, the invention relates to a booster seat which allows a seat portion to be positioned at one of a multiple set of height positions.

BACKGROUND OF THE INVENTION

Booster seats have been used by young children for a number of years. They are used extensively in the restaurant industry and the home and, to a lesser extent, in theatres. Generally, booster seats have a base with a seat portion. The seat portion is typically immovable. Placement of the booster seat on a conventional chair will elevate the user of the seat so as to be more conveniently positioned at a table. Most known booster seats are dimensioned to properly position an average aged child with an average size at one height position.

Certain booster seats have been produced to better accommodate a child who is still in need of a booster seat, yet because of his particular age or size is not well served by the typical one height position booster seat. One such booster seat is capable of being placed on a conventional chair in either of two positions. That is, the booster seat's base can be positioned downside down or downside up. A seat portion is offset from the base's mid-point so that two different seat height positions can be attained depending on how the base is placed on the chair. However, even this booster seat only allows for two seat heights.

A need exists for a booster seat which can conveniently accommodate a child in a number of different height positions depending on the child's needs. The booster seat must be economical to produce and easy to operate. In accordance with this invention, there has been invented a booster seat which is capable of accommodating a child in a number of different seat heights according to the child's needs. The seat height of the booster seat is readily adjusted by a parent or other responsible individual.

SUMMARY OF THE INVENTION

A booster seat intended for use by children is capable of having a seat portion positioned at different heights according to the needs of the user. The booster seat comprises an open-sided base and a seat piece. The open-sided base has a back support and two side supports. Each side support of the base has a forward channel with a set of vertically spaced substantially level ledges and a back channel with a set of vertically spaced substantially level ledges. The seat piece is removable from the open-sided base and is capable of being positioned on a desired set of ledges found in the forward and back channels of the base. The seat piece has a forward protrusion and a vertically offset back protrusion in each of its sides. The protrusions are dimensioned to rest upon the selected ledges of the open-sided base's channels.

DETAILED DESCRIPTION OF THE INVENTION

Figure 1:
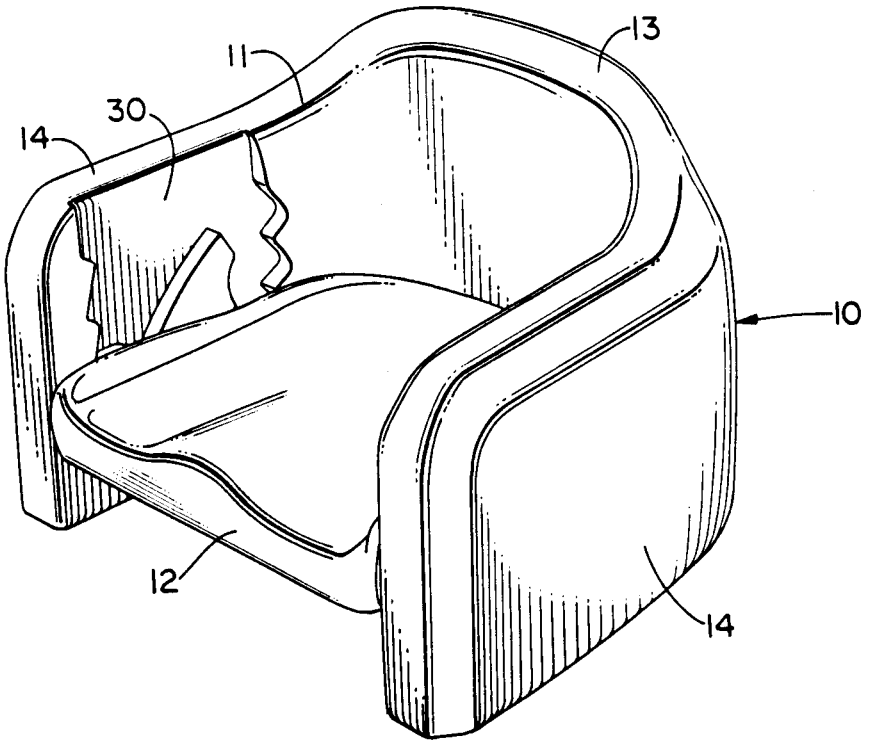
FIG. 1 is a perspective view of the booster seat of the invention showing a seat piece positioned at a selected height in an open-sided base.

The booster seat of this invention is described with reference to the drawings. The booster seat in FIG. 1 shown generally as 10 comprises an open-sided base 11 and a seat piece 12. While not shown, it is well recognized that booster seats in general are dimensioned to fit on a conventional chair. They are strong enough to hold a child ranging up to about fifty pounds in weight. The booster seat of this invention is preferably comprised of blow molded or roto-molded plastic parts. As further described below, the seat piece is capable of being positioned in any one of a plurality of selected height positions in the open-sided base.

Figure 2:
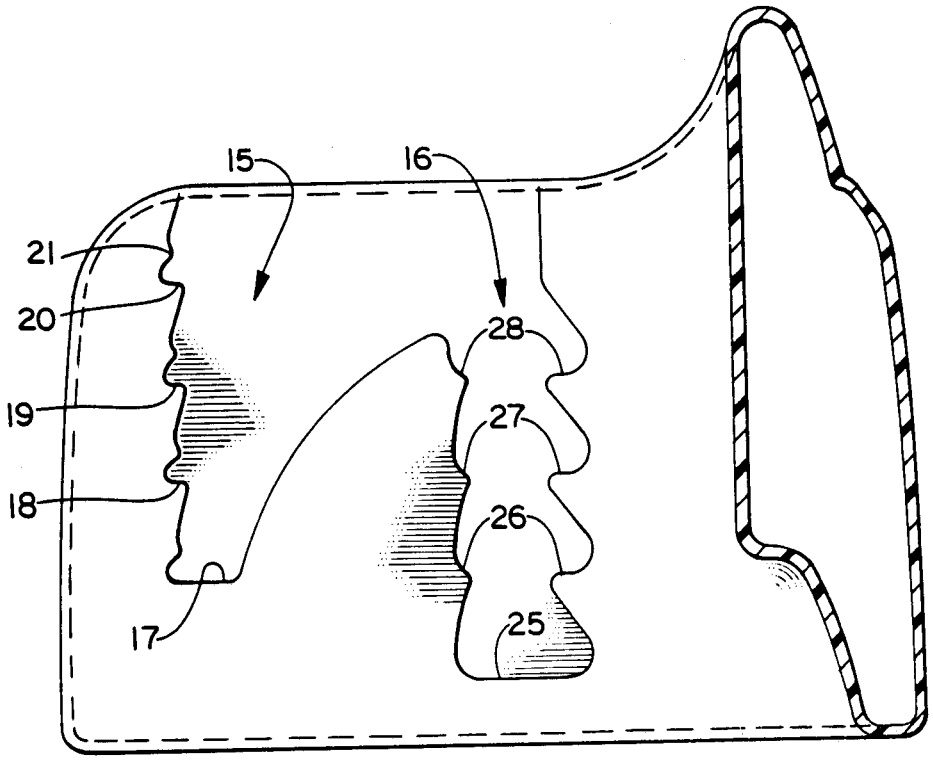
FIG. 2 is a side view of the inside surface of one side of the open-sided base shown on FIG. 1.
Figure 3:
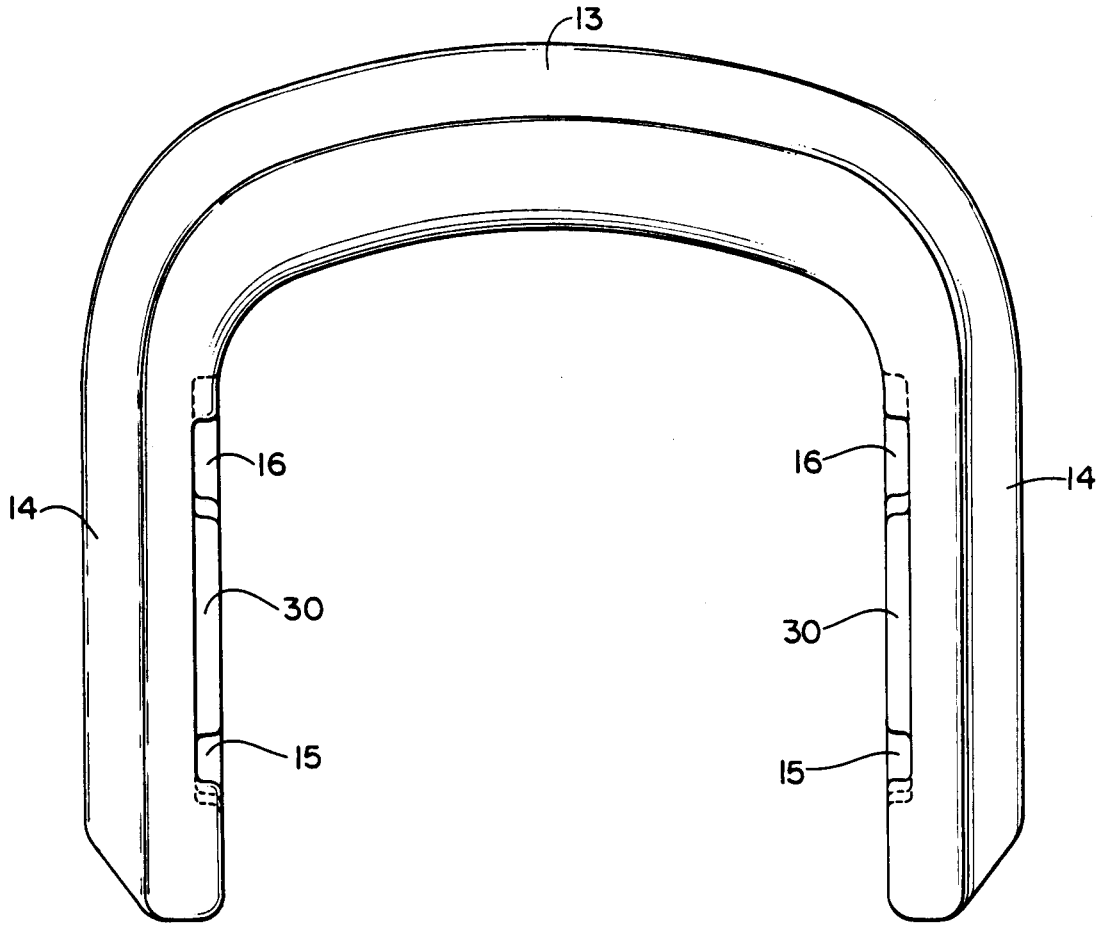
FIG. 3 is a top view of the open sided base of FIG. 2.

With reference to FIGS. 1–3, there is shown the open-sided base 11. The open-sided base is one integral piece with a back support 13 and two side support 14. The back and side supports are contoured to comfortably accommodate a child. Each side support has a forward channel 15 and a back channel 16. The two channels are open at their top portions and in effect are each in communication.

The forward channel 15 extends in a vertical direction down the side support with channel end 17 near the support's bottom surface. A set of vertically spaced substantially level ledges 18–20 extend from a front edge of the channel. As will become evident, the channel's end and each ledge provides a support upon which can rest the seat piece and represents one of the multiple height positions of the booster seat. The back edge of the forward channel fans out near its top towards the back channel to provide an open unobstructed area through which the seat piece can move during assembly.

A boss 21 is optionally provided in the front edge of channel 15 above end 17 and ledges 18–20. Each boss is positioned such that it frictionally engages the seat piece during assembly to effect a snap-in action. The bosses also offer resistance to pivot movement of the seat piece from a level position when unoccupied.

Back channel 16 also extends in a vertical direction along the side support 14 with channel end 25 near the support's bottom surface. A set of vertically spaced substantially level ledges 26–28 extend from each side of the channel 16. While a double set of ledges is shown at each height position, it will be appreciated that a single ledge along either side of the channel could be used. However, the double ledges provide increased support for the seat piece and are highly preferred for this reason. The end 25 and each of the ledges 26≧28 is vertically offset a substantially equal distance from end 17 and a corresponding ledge 18–20 found in the forward channel. Thus, the vertical distance between end 25 and end 17 is substantially equal to the distance between ledge 26 and ledge 18 and so on. The exact distance between each ledge is dependent on the desired height selection to be made available. Generally, the vertical distance between each ledge ranges from about 0.75 inches to about 1.5 inches.

Forward channel 15 and back channel 16 are open at their top portions to receive the seat piece 12. The recessed area 30 into which the channels open is beveled outwardly to better receive the seat piece and allow its movement during assembly.

Figure 4:
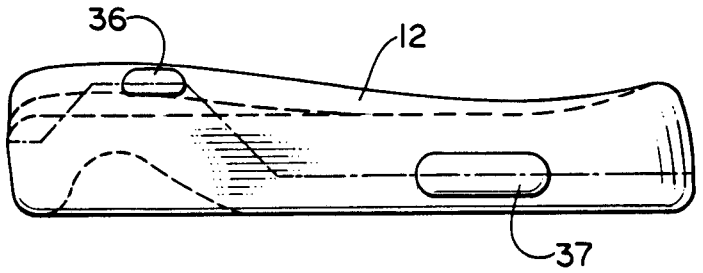
FIG. 4 is a side view of the seat piece shown in FIG. 1.
Figure 5:
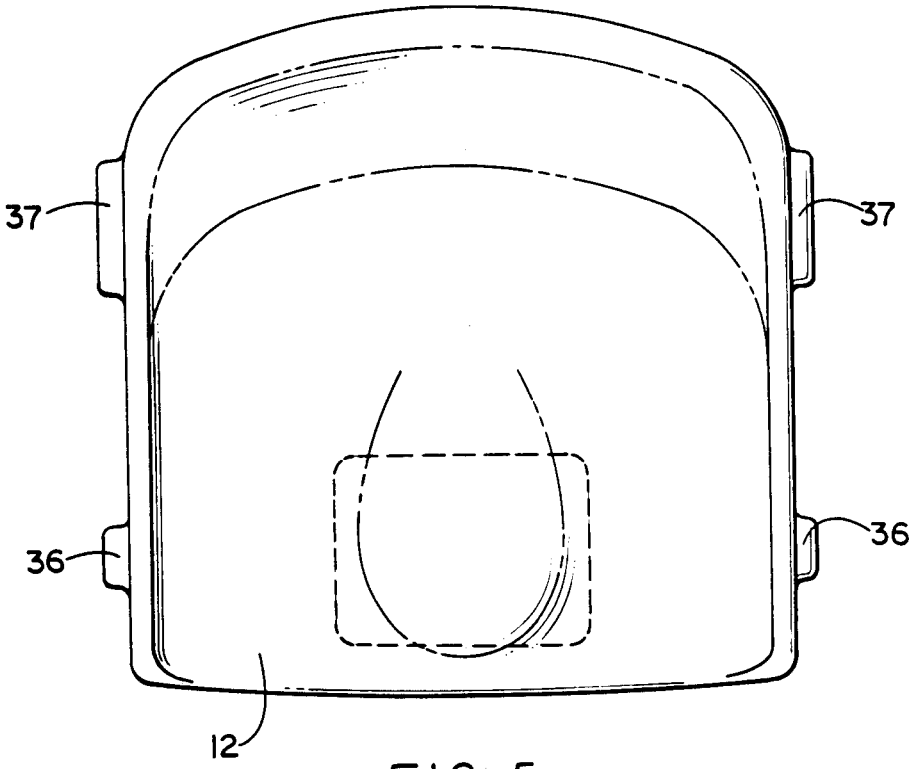
FIG. 5 is a top view of the seat piece of FIG. 4.
Figure 6:
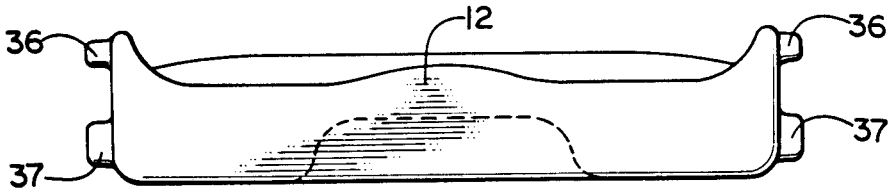
FIG. 6 is a front view of the seat piece of FIG. 4.

FIGS. 4–6 illustrate the seat piece 12 used in the booster seat. The seat piece has a contoured top surface to comfortably receive a child and is dimensioned to fit in the open-sided base 11 with a minimum of clearance between it and the open-sided base's side supports and back support. Two protrusions are found on each side edge 35 of the seat piece and are intended to rest upon the channel ends or selected ledges found in the forward and back channels of the base 11. A forward protrusion 36 and back protrusion 37 are vertically offset from one another. The offset distance is equal to the offset distance found between corresponding ends and ledges in the forward and back channels. As readily apparent, the forward and back protrusions are positioned laterally on the side edge to mate with the ledges of the open-sided base. Each protrusion has generally an elongated oval shape, though other protrusion shapes can as well be used.

Figure 8:
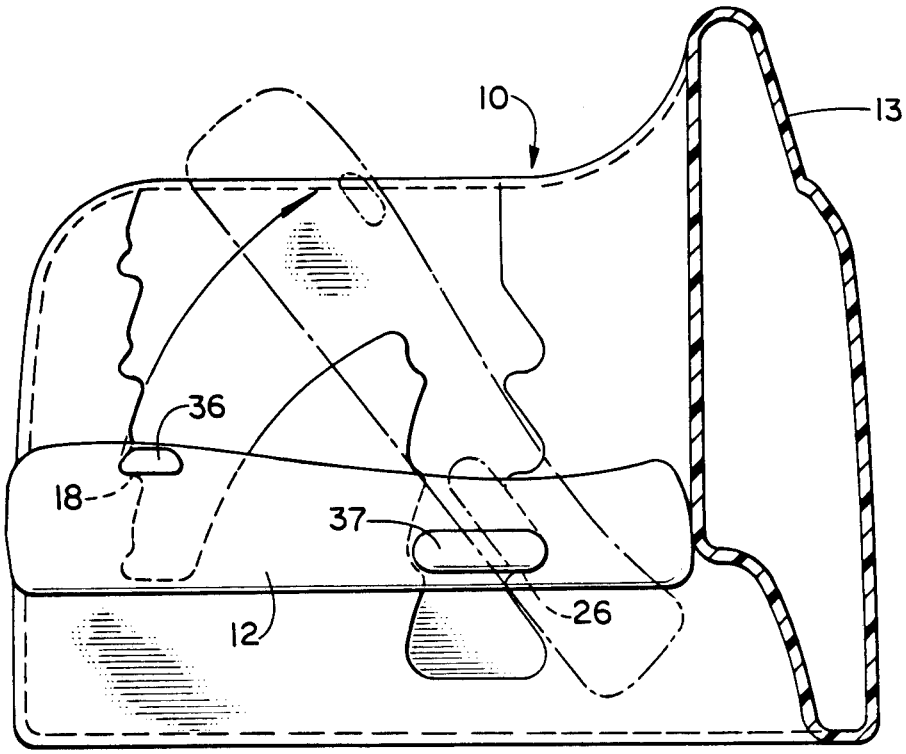
FIG. 8 is a perspective view showing the assembly of the booster seat of FIG. 1.

The booster seat of FIGS. 1–6 is depicted with three ledges in each channel and accordingly has four height positions at which the seat piece can be positioned. Any number of ledge sets can be provided, though from two to five ledge sets is sufficient in most cases. As shown in FIG. 8, a seat height is obtained by initially holding the seat piece in a plane substantially perpendicular to the horizontal and sliding it down into back channels 16 until a level ranging from the end 25 to uppermost ledge 28 is reached. The back protrusions 37 are aligned with the end or selected back ledge in the channel. Next, the seat piece is pivoted about the point where the back protrusions rest upon the end or selected ledge towards the front of the open-sided base. As the seat piece descends, the forward protrusions 36 move through the fanned-out portion of the open area 30 and down into the forward channels 15. The area 30 through which the seat piece moves must be recessed sufficiently so that when the seat piece is positioned in the lowermost height and pivoted forwardly, the forward protrusions 36 are unobstructed in their movement into the forward channels of the open-sided base.

The seat piece is steadied when the forward protrusions engage a ledge corresponding to a back ledge upon which the back protrusions 37 rest. Further movement of the seat piece in a downward direction is no longer possible. The seat piece attains a substantially level or horizontal position with the forward and back protrusions on each side ledge resting upon a ledge on the open-side base. The seat piece is now secured in that obviously the seat piece is incapable of vertical or lateral movement with a child sitting in the booster seat.

Figure 7:
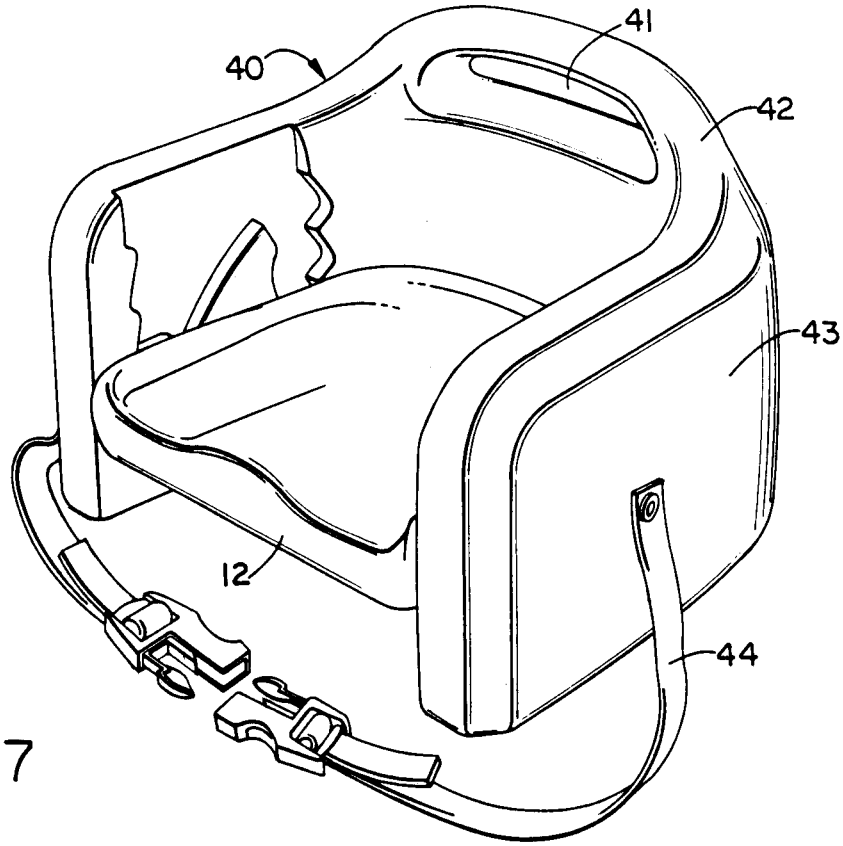
FIG. 7 is a perspective view of another embodiment of the booster seat of the invention showing provisions for a safety belt and a handle.

FIG. 7 is a perspective view of a booster seat 40 of this invention wherein optional features have been added. A cut-out portion 41 in the back support 42 of the open-sided base 43 is conveniently used to grasp the seat and transport it. A safety belt 44 attached to the base is intended to wrap around a chair on which the booster seat is positioned. Latching attachment means found on the safety belt hold the booster seat to the chair for obvious safety reasons. Still another feature the booster seat of FIG. 7 is a bevelled portion of the bottom surfaces on the open-side base so as to allow the base to stack upon a similarly dimensional booster seat during storage.

The invention has been described with specific reference to the drawings. It should be apparent that obvious modifications can be made to the described invention. For example, the forward and back channels in the open-sided base can extend from an open area at the bottom surface of the side support towards the top of the side support. In this embodiment the seat piece during assembly slides upwardly in the back channel in a plane perpendicular to the horizontal until a selected ledge is reached and then pivoted forwardly. This and other obvious variations are contemplated as being within the scope of the following claims.

What is claimed is:

1. A booster seat for accommodating a child in one of a plurality of selected height positions, comprising:

(a) an open-sided base with side and back supports, each side support having a forward channel with a set of vertically spaced substantially level ledges and a back channel with a set of vertically spaced substantially level ledges, each ledge of said forward set of ledges vertically offset from each corresponding ledge in the back set of ledges; and (b) a removable seat piece dimensioned to fit in the open-sided base and rest on the forward and back set of ledges in a substantially horizontal position, wherein each side of the seat piece has a forward protrusion and a back protrusion vertically offset from one another, each of said back protrusions dimensioned to slide in the back channels of the open-sided base when said seat piece is held in a plane substantially perpendicular to the horizontal until a ledge at a selected height is reached whereupon pivotable movement of the seat piece towards a horizontal plane causes each back protrusion to rest upon the ledges at the selected height and each forward protrusion to move downwardly in the forward channels until each rests upon one of the ledges such that the seat piece is substantially horizontal and secured in the open-sided base at the selected height.

2. The booster seat of claim 1 wherein the end of the forward channel of the open-sided base is vertically offset from the end of the back channel of the open-sided base by a distance substantially equal to the vertical distance between the forward protrusion and the back protrusion found on the seat piece and each succeeding forward ledge is vertically offset substantially the same distance from each corresponding succeeding back ledge.

3. The booster seat of claim 1 wherein the horizontal distance between the forward protrusions and the back protrusions on the seat piece is substantially the same as the horizontal distance between the ledges in the forward channels and back channels.

4. The booster seat of claim 3 wherein the forward channel and back channel in the open-sided base each extend in a vertical direction from a top of the base to near a bottom of the base.

5. The booster set of claim 4 wherein a top portion of the channels is beveled outwardly.

6. The booster seat of claim 1 wherein the set of vertically spaced ledges in each of the back channels is a double set of ledges opposite one another in the channel wherein each back protrusion of the seat piece rests upon two oppositely spaced ledges.

7. The booster seat of claim 6 wherein the vertically spaced ledges in each of the forward channels extend from a front edge of the channel.

8. The booster seat of claim 7 wherein a back edge of each of the forward channels fans out toward each of the back channels so that when the seat piece is positioned to rest on the channel ends and pivots towards the horizontal, each of the forward protrusions passes through the fanned-out portion to finally rest on the end of the forward channel.

9. The booster seat of claim 1 wherein each protrusion has an elongated oval shape.

10. The booster seat of claim 1 wherein the open-sided base has a cut-out in the back support to act as a handle means for the booster seat.

11. The booster seat of claim 10 further comprising a seat belt attached to the open-sided base for the purpose of securing the booster seat to a chair.

12. The booster seat of claim 11 wherein the open-sided base is dimensioned in its bottom portion to stack upon another booster seat.

13. The booster seat of claim 1 wherein each set of vertically spaced ledges has from two to five ledges.

14. The booster seat of claim 1 wherein an end of each of the forward channels and back channels functions as a ledge upon which the seat piece rests.

15. The booster seat of claim 14 wherein a boss is positioned above each ledge in the forward channel to frictionally engage the seat piece during assembly.

* * * * *